US006167720B1

(12) United States Patent
Chisnell

(10) Patent No.: US 6,167,720 B1
(45) Date of Patent: Jan. 2, 2001

(54) ACCUMULATOR BAFFLE MOLDED FROM DESICCANT

(75) Inventor: Jerry H. Chisnell, Northville, MI (US)

(73) Assignee: Automotive Fluid Systems, Inc., Troy, MI (US)

( * ) Notice: Under 35 U.S.C. 154(b), the term of this patent shall be extended for 0 days.

(21) Appl. No.: 09/420,481

(22) Filed: Oct. 19, 1999

(51) Int. Cl.[7] ..... F25B 43/00
(52) U.S. Cl. ..... 62/474; 62/503
(58) Field of Search ..... 62/474, 503; 29/902

(56) References Cited

U.S. PATENT DOCUMENTS

| | | | | |
|---|---|---|---|---|
| 4,447,565 | | 5/1984 | Lula et al. . | |
| 4,474,035 | * | 10/1984 | Amin et al. | 62/503 |
| 4,629,483 | | 12/1986 | Stanton . | |
| 4,768,355 | * | 9/1988 | Breuhan et al. | 62/503 |
| 4,886,240 | * | 12/1989 | Rich | 250/352 |
| 5,114,584 | | 5/1992 | Sheckler et al. . | |
| 5,184,480 | * | 2/1993 | Kolpacke | 62/503 |
| 5,215,686 | | 6/1993 | Sheckler et al. . | |
| 5,376,273 | | 12/1994 | Pacheco et al. . | |
| 5,377,501 | * | 1/1995 | Muston | 62/475 X |
| 5,384,047 | | 1/1995 | Sheckler et al. . | |
| 5,385,953 | | 1/1995 | McClellan . | |
| 5,423,129 | | 6/1995 | Castle et al. . | |
| 5,440,898 | | 8/1995 | Starr . | |
| 5,505,892 | | 4/1996 | Domme . | |
| 5,966,810 | * | 10/1999 | Chisnell et al. | 62/474 X |

* cited by examiner

*Primary Examiner*—William Doerrler
*Assistant Examiner*—Chen-Wen Jiang
(74) *Attorney, Agent, or Firm*—Vanophem Meehan & Vanophem, P.C.

(57) ABSTRACT

A dome-shaped baffle for an accumulator molded from desiccant material, which baffle separates and dries liquid and vapor components of an incoming flow of refrigerant while preventing the liquid refrigerant from entering an outlet tube. The dome-shaped baffle forces all of the refrigerant to contact the desiccant and has a barrier layer attached underneath that prevents liquid refrigerant from flowing through the baffle and directly into an inlet end of the outlet tube.

8 Claims, 2 Drawing Sheets

ACCUMULATOR BAFFLE MOLDED FROM DESICCANT

BACKGROUND OF THE INVENTION

1. Field of the Invention

The present invention generally relates to an accumulator for use in an air-conditioning system, where the accumulator separates a refrigerant into liquid and vapor components. More particularly, the present invention relates to a molded desiccant baffle for drying and directing the refrigerant.

2. Description of the Prior Art

It is common practice in today's accumulator technology to use a baffle plate or deflector to help ensure that liquid refrigerant does not enter the inlet end of the outlet tube. Accordingly, U.S. Pat. No. 4,474,035 to Amin et al. discloses a domed baffle located in an upper region of the accumulator housing adjacent to the accumulator inlet opening. The liquid refrigerant enters the accumulator housing through the inlet opening in the top of the housing and is dispersed over the dome of the baffle toward the sides of the housing. This creates a vertical flow down the sides of the accumulator housing.

Consequently, the vapor component of the refrigerant collects in the upper region of the housing, beneath the baffle, and near the inlet end of an outlet tube. The inlet end of the outlet tube is located directly below the domed baffle plate where it is protected from the liquid component of incoming refrigerant. Next, Amin et al. disclose a bag containing loose desiccant particles located in the bottom portion of the accumulator, below the baffle plate, that is secured to the outlet tube by a strap. The loose desiccant particles absorb any moisture that may be present in the vapor component of the refrigerant as it passes through the accumulator.

Unfortunately, there are disadvantages associated with using a bag for the desiccant as disclosed in Amin et al. For example, the bag is easily damaged during assembly and testing. A tear in the bag allows the loose desiccant particles to escape and potentially enter the air-conditioning system where they can damage the accumulator and other components. Furthermore, there are other disadvantages, including attrition between individual particles that causes powdering and packing, thereby reducing the penetrability and the effectiveness of the desiccant. Loose desiccant also has a tendency to develop channels where the refrigerant can flow freely without passing through desiccant particles, bypassing the drying effects of the desiccant.

U.S. Pat. Nos. 5,114,584 and 5,384,047, both to Sheckler et al., attempt to overcome the problems associated with loose desiccant particles by disclosing a filter body comprised of a molecular sieve material. Sheckler et al. disclose combining a predetermined amount of molecular sieve material with a predetermined amount of nylon material and compacting the mixture into a disc or puck-shaped body. The compacted body is heated while being subjected to pressure forming a filter body.

U.S. Pat. No. 5,440,898 to Starr discloses a filter-drier core molded from a permeable matrix including desiccant particles, a binder, and reinforcing fibers. The reinforcing fibers are fixed in place by the binder and impart strength and permeability to the filter-drier core.

The filter bodies disclosed in Sheckler et al. and the filter-drier core disclosed in Starr are products that require a flow rate of liquid through the filter. Thus, the refrigerant liquid must pass completely through the filter to gain the advantage of the desiccant's drying properties.

In an accumulator, it is undesirable for liquid refrigerant, or any other moisture, to exit the accumulator. Only the gaseous or vapor component of the refrigerant should pass out of the accumulator, because any moisture in the gaseous component will deter proper functioning of the air-conditioning system. Accordingly, the baffle prevents any liquid refrigerant from accidentally passing into the outlet tube of the accumulator. The refrigerant should be dried by the desiccant so that a minimum amount of moisture is allowed to re-enter the air-conditioning system after collecting underneath the baffle and passing through the rest of the accumulator.

Moreover, it is undesirable from a manufacturing point of view to have multiple components in an accumulator assembly. Thus to improve product cost and quality it is desirable to reduce, or limit, the number of components that are required for efficient accumulator operation. What is needed is an accumulator that has fewer components than prior art accumulators, yet functions at least as efficiently as present day accumulator systems.

SUMMARY OF THE INVENTION

The present invention is an accumulator baffle molded from a desiccant material that functions to separate the liquid and vapor components of incoming refrigerant while preventing liquid refrigerant from entering the outlet tube. The desiccant material dries the vapor component of the refrigerant before it passes out of the accumulator via the outlet tube.

The present invention overcomes many of the disadvantages associated with prior art accumulators and the way that desiccant material is packaged by eliminating the need for a separate bag, or other container, to house loose desiccant particles. The baffle of the present invention is molded from a solid desiccant material thereby eliminating the problems of attrition and channels normally associated with loose desiccant material.

The present invention also reduces the number of components required in the accumulator by combining the baffle and the desiccant, thereby simplifying assembly and lowering manufacturing costs. The efficiencies in assembly and manufacturing are not the only savings. Fewer components result in lower part costs and less potential for failure, such that not only are manufacturing costs greatly reduced, but also part cost is reduced and product quality is increased.

The dual function component of the accumulator allows both a fixed location of the desiccant material near the top of the accumulator housing, and forces all of the refrigerant, liquid and vapor, to pass through the desiccant material. The shape of the baffle can be modified to accommodate a variety of accumulator designs.

It is an object of the present invention to separate a flow of refrigerant into vapor and liquid components and at the same time dry the vapor component of the refrigerant flow.

It is another object of the present invention to reduce the number of components required in an accumulator assembly.

It is yet another object of the present invention to avoid the drawbacks associated with loose desiccant material by using a solid desiccant material.

It is a further object of the present invention to provide a baffle for an accumulator assembly molded from a desiccant material to both separate and dry a flow of refrigerant while using fewer components in the accumulator assembly.

These objects, features and advantages of the present invention are readily apparent from the following detailed description of the best mode for carrying out the present invention when taken in conjunction with the accompanying drawings.

DETAILED DESCRIPTION OF THE PREFERRED EMBODIMENT

Figure 1:
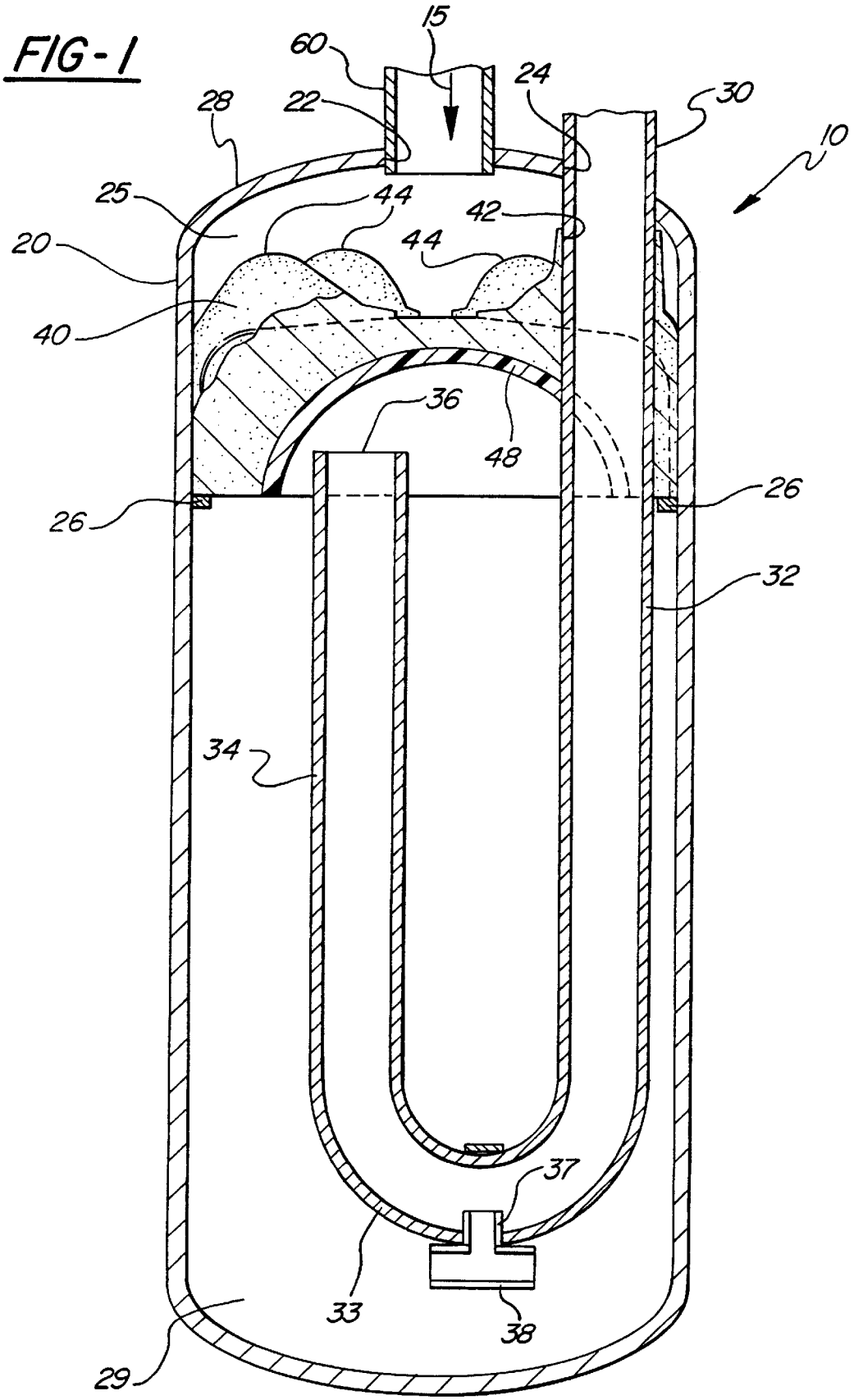
FIG. 1 is a cross-sectional view, shown in partial cut away, of the desiccant baffle of the present invention as assembled in an accumulator.

With reference to FIG. 1 there is shown an accumulator assembly 10, including a generally cylindrical housing 20 that is completely sealed except for an inlet opening 22 and an outlet opening 24 in a top 28 of the housing 20. The inlet opening 22 accommodates an inlet tube 60 that supplies a flow of refrigerant 15 into the accumulator assembly 10.

The outlet opening 24 accommodates an outlet or U-tube 30, that includes a first leg 32 extending from the outlet opening in the top of the housing 20 to a bottom end or lower region 29 of the housing 20 wherein a bight portion 33 of the outlet tube is positioned. The bight portion 33 has an oil pick up tube 37 and an oil filter 38 mounted thereon. A second leg 34 of the outlet tube 30 extends upward from the bight portion 33 of the outlet tube 30 back toward the top 28 of the housing 20. Additionally, an inlet end 36 is located at the end of the second leg 34 of the outlet tube 30 and is preferably positioned underneath a baffle 40.

Figure 2:
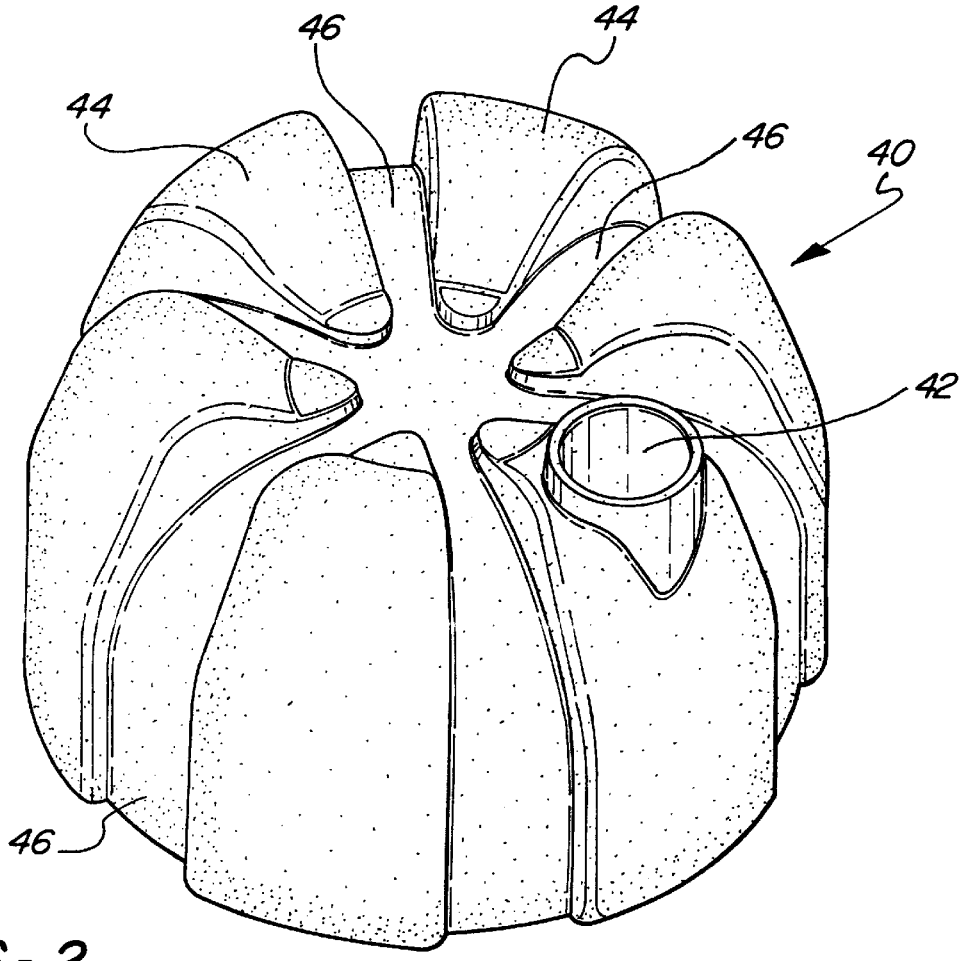
FIG. 2 is a perspective view of a desiccant baffle of the present invention.

Referring now to FIGS. 1 and 2, the baffle 40 of the present invention is located inside the upper region 25 of the housing 20, is generally domed shaped, and is composed of solid desiccant material. Further, the baffle 40 has an opening 42 through which the outlet tube 30 passes. The outlet tube 30 is expanded within the opening 42 to retain the baffle 40 in a position directly over the inlet end 36 of the outlet tube 30. Also, the baffle 40 is peripherally supported by a ring 26 attached to the housing 20. Additionally, a skin or barrier layer 48, is integrally or separately attached underneath the baffle 40 to prevent liquid refrigerant from flowing into the inlet end 36 of the outlet tube 30.

In the embodiment shown in FIGS. 1 and 2, the baffle 40 has a plurality of spaced apart raised sections 44, one of which contains the opening 42. The spaced apart raised sections 44 define a plurality of channels 46 therebetween. The channels 46 direct the incoming flow of refrigerant and aid in separating the vapor component of the refrigerant from the liquid component.

Figure 3:
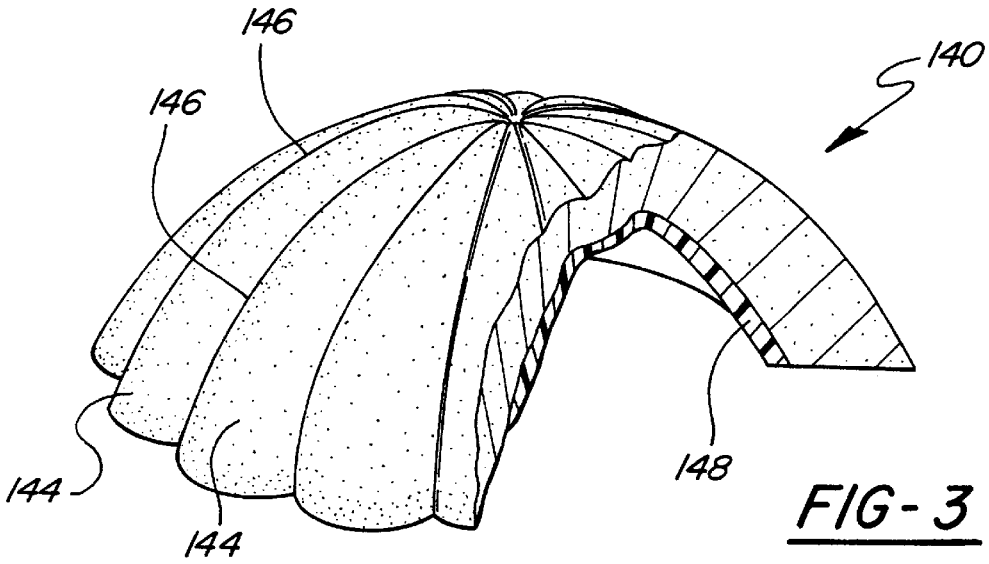
FIG. 3 is a perspective view of another embodiment of the baffle of the present invention.

FIG. 3 illustrates another embodiment of the present invention in the form of a solid desiccant baffle 140. The baffle 140 has raised sections 144 that are not spaced apart, but are contiguous, similar to sections of an umbrella. There are channels 146 located between adjacent raised sections 144, that serve to direct the flow of refrigerant and aid in separating the liquid and vapor components of the refrigerant. Again, the baffle 140 has a skin 148 that shields the inlet end (not shown) of the outlet tube (not shown) from refrigerant flow. An opening (not shown) for the outlet tube may also be included.

In general, the baffle is molded from a desiccant material by a process known to one skilled in the art, such as a process that is proprietary to Union Carbide. Their process also allows the filler material to take the shape of and replace the skin. As an alternative, a separate plastic skin can be molded to the underside of the baffle.

An advantage of molding the baffle from desiccant material is that molding allows the baffle to perform the function of two parts in one. First, the baffle directs the incoming flow of refrigerant and prevents the refrigerant from entering the inlet end of the outlet tube, as a typical baffle does. Second, the desiccant of the baffle dries the fluid, thereby eliminating the need for a separate desiccant component. Combining the baffle and the desiccant is novel and results in use of fewer components. and therefore eases assembly and reduces part costs.

Furthermore, the solid desiccant baffle has advantages over loose desiccant particles contained in a bag. The solid desiccant baffle is not easily damaged during assembly and testing as is the fragile bag that is used to hold loose desiccant particles in prior art accumulators. During assembly of an accumulator system, the accumulator housing is subjected to a brazing oven at extremely high temperatures. The solid desiccant baffle of the present invention is capable of withstanding this high heat, whereas a fragile bag containing loose desiccant cannot.

A further advantage of the solid desiccant baffle of the present invention is that it remains in a fixed location and cannot shift position within the housing as is seen in prior art accumulators that use a bag of loose desiccant particles to dry the refrigerant.

Additionally, the solid construction of the baffle maintains a fixed path for the refrigerant as it passes over the baffle. There is no chance of developing channels within the loose desiccant particles that allow the fluid to bypass the drying properties of the desiccant. In the accumulator assembly of the present invention, there is no other path for the refrigerant to follow other than over the baffle, where it is subjected to the drying properties of the desiccant.

The volume of the molded desiccant in the present invention is the same as the volume of loose desiccant used in prior art accumulator systems. The desiccant baffle provides the same amount of desiccant as the loose desiccant in a bag, yet provides the advantages discussed above that loose desiccant in a bag is unable to accomplish.

While two embodiments have been illustrated in the accompanying drawings and described in the foregoing description with particular specifics, it is to be understood that the present invention is not to be limited to just the embodiments disclosed herein. Numerous rearrangements, modifications and substitutions are possible without departing from the scope of the following claims. One skilled in the art is capable of modifying the design and shape of the baffle to accommodate different accumulator designs.

What is claimed is:

1. An accumulator assembly comprising:

a housing having a top end and a bottom end, said top end of said housing having an inlet opening and an outlet opening;

an outlet tube extending into said housing by way of said outlet opening, said outlet tube having an inlet end located within said housing, said outlet tube further having a bight portion positioned near said bottom end of said housing, said bight portion having an oil pick up tube and an oil filter thereon; and unitary means for dispersing and drying a flow of refrigerant, said unitary means being located in an upper region of said housing, wherein said unitary means comprises a baffle positioned above said inlet end of said outlet tube within said housing, said baffle being molded from desiccant material, whereby said baffle functions to deflect a flow of refrigerant and to remove moisture from said flow of refrigerant.

2. An accumulator assembly as claimed in claim 1, wherein said baffle is dome-shaped.

3. An accumulator assembly as claimed in claim 2, wherein said baffle further includes a barrier on the underside of said baffle for preventing liquid refrigerant from passing through said baffle into said inlet end of said outlet tube.

4. An accumulator assembly as claimed in claim 3, wherein said baffle further includes a plurality of raised sections defining a plurality of channels therebetween for deflecting and drying said flow of refrigerant, said plurality of raised sections having an opening therethrough for receiving said outlet tube.

5. A baffle for an accumulator assembly wherein said baffle comprises unitary means for dispersing and drying a flow of refrigerant in an accumulator, wherein said unitary means includes a body molded from desiccant material.

6. A baffle as claimed in claim 5 wherein said body is dome-shaped.

7. A baffle as claimed in claim 6 wherein said body includes a barrier attached underneath said body for preventing liquid refrigerant from passing through said body.

8. A baffle as claimed in claim 7 wherein said body further includes a plurality of spaced apart raised sections defining a plurality of channels therebetween for deflecting and drying said flow of refrigerant.

* * * * *